United States Patent [19]

Carlson et al.

[11] Patent Number: 4,973,448

[45] Date of Patent: Nov. 27, 1990

[54] VAPOR PHASE CORROSION INHIBITOR PRODUCT AND METHOD CONTAINING A DESICCANT

[75] Inventors: Richard R. Carlson, Minneapolis, Minn.; Nelson E. Malwitz, Brookfield, Conn.; Benjamin H. Hill, St. Paul, Minn.; Philip J. Martin, Hickory, N.C.

[73] Assignee: Cortec Corporation, St. Paul, Minn.

[21] Appl. No.: 269,487

[22] Filed: Nov. 10, 1988

Related U.S. Application Data

[63] Continuation-in-part of Ser. No. 932,167, Nov. 18, 1986, abandoned.

[51] Int. Cl.[5] ..... C23F 11/02; B65D 67/00

[52] U.S. Cl. ..... 422/9; 206/602; 206/606; 206/608; 206/610; 206/611; 206/618; 239/34; 239/60; 252/389.54

[58] Field of Search ..... 422/9; 206/602, 606, 206/608, 610, 611, 618; 239/60, 34; 252/389.054

[56] References Cited

U.S. PATENT DOCUMENTS

| | | | |
|---|---|---|---|
| D. 138,698 | 9/1944 | Salfisberg | 206/602 |
| 2,078,488 | 4/1937 | Farnham | 206/602 |
| 2,156,357 | 5/1939 | Simpson . | |
| 2,898,026 | 8/1959 | Aid . | |
| 2,914,424 | 11/1959 | Murray . | |
| 3,151,919 | 10/1964 | Barth . | |
| 3,286,831 | 11/1966 | Giberstein | 206/602 |
| 3,356,280 | 12/1967 | Dunholter . | |
| 3,433,577 | 3/1969 | Shick . | |
| 3,464,540 | 9/1969 | Stark . | |
| 3,534,887 | 10/1970 | Ginsberg | 206/614 |
| 3,835,995 | 7/1974 | Haines | 206/602 |
| 3,936,560 | 2/1976 | Santurri et al. . | |
| 3,990,872 | 11/1976 | Cullen . | |
| 4,308,168 | 12/1981 | Sato et al. . | |
| 4,453,786 | 6/1984 | Landell . | |

FOREIGN PATENT DOCUMENTS

| | | | |
|---|---|---|---|
| 131971 | 1/1946 | Australia | 422/9 |

*Primary Examiner*—Robert J. Warden
*Assistant Examiner*—Jill Johnston
*Attorney, Agent, or Firm*—Orrin M. Haugen; Thomas J. Nikolai; Frederick W. Niebuhr

[57] ABSTRACT

A product for inhibiting corrosion of corrodible items within closed containers which comprises a powdered solid composition capable of producing and releasing a vapor phase corrosion inhibiting compound. The powdered composition is enclosed within a sealed envelope which is formed of a sheet material impermeable to the powdered composition, but which is porous to the released vapor phase corrosion inhibiting compound released from the powdered composition. The vapor phase corrosion inhibiting compound produced and released by the powdered composition migrates through the sheet material and permeates the environment of a closed container of corrodible items.

33 Claims, 2 Drawing Sheets

VAPOR PHASE CORROSION INHIBITOR PRODUCT AND METHOD CONTAINING A DESICCANT

CROSS-REFERENCE TO RELATED APPLICATION

This is a continuation-in-part of our co-pending application Ser. No. 06/932,167, filed Nov. 18, 1986, entitled "VAPOR PHASE CORROSION INHIBITOR PRODUCT AND METHOD", now abandoned.

FIELD OF THE INVENTION

The present invention relates to products and methods for inhibiting the corrosion of metal items by providing vapor phase inhibitor compounds within packages or other enclosures containing corrodible items, and alternatively by providing vapor phase inhibitor compounds together with desiccants to reduce the water vapor within the enclosure.

BACKGROUND OF THE INVENTION

In a number of applications, such as product packaging or other closed systems, corrodible items must be protected from reacting with their environment and losing their effectiveness or value during packaging, handling, transportation or end use. As would be expected, the most common example of such corrosion is that of metal items which tend to corrode, i.e., oxidize, pit, tarnish, mottle or discolor, in the presence of oxygen and moisture. Because both oxygen and water vapor are abundantly available under normal atmospheric and ambient conditions, precautions are necessary when packaging or otherwise using certain metal items. Items formed from iron, steel, copper, brass, aluminum, silver, and many alloys of such metals, are susceptible to such corrosion, as are materials with sacrificial or aesthetic coatings such as zinc or cadmium.

One method of protecting corrodible items has been to provide a package or other enclosure which includes one or more uncontained corrosion inhibiting compounds along with the corrodible item or items. Such corrosion inhibitors can include solids and liquids, and can be used in a number of ways. In some applications, the corrodible items are thoroughly coated with a corrosion inhibiting compound in the form of a solid, or a liquid, or a grease or a paste and then packaged or enclosed in closed containers. Although some degree of corrosion protection results, the presence of such coating on the corrodible items has obvious handling and packaging disadvantages.

Solid corrosion inhibitors, e.g. powders, pills or tablets, present a different set of disadvantages. Particulate materials can foul certain mechanical items, be aesthetically displeasing, and can be difficult to remove from the protected items when they are finally unpacked or otherwise put to use. Moreover, the types of chemicals necessary for inhibiting corrosion are often somewhat hazardous to persons if they are inhaled or come into contact with their skin.

In other applications, solid phase or liquid phase compounds are used which are generally referred to as vapor phase inhibitors (VPI) or, as used herein, volatile corrosion inhibitors (VCI). Such compounds emit vapors which protect corrodible substrates by depositing a protective coating upon the substrates. Because molecules in the vapor phase disperse very rapidly, even at ambient conditions or even cooler temperatures, a vapor phase corrosion inhibitor will generally set up an equilibrium environment rather quickly. In such an environment, the corrosion inhibiting compounds provided by the volatile corrosion inhibitors (VCI) can reach and protect all of the items in the enclosed environment much more efficiently than could solids or liquids, that are only effective when in contact with the corrodible substrate. Additionally, because of their rapid dispersal, removal of the protective vapors emitted from volatile corrosion inhibits from the items is unnecessary when the items themselves are removed from their respective packages or otherwise put to use.

Several techniques for using volatile corrosion inhibitors have evolved to date. One method comprises forming a tablet or some other solid shaped element from a solid compound which will either sublime into, or chemically release, the vapor phase corrosion inhibitor. In other techniques package walls or other substrates are painted or coated with volatile corrosion inhibitor-containing compositions which release protective vapors. Other techniques blend volatile corrosion inhibitor compounds with or impregnate them into materials such as foamed or foamable compositions so that a foamed article results which protects the items from physical shock, as well as from corrosion.

Generally speaking, some of the liquid or solid corrosion inhibiting compounds used in such techniques include triazoles; organic or inorganic nitrites, nitrates, carbonates, phosphates; primary, secondary, tertiary, or quaternary amines (aliphatic or aromatic) or their organic or inorganic acid salts. It will be understood, however, that such techniques can use other appropriate compounds, as well as those listed herein.

All of these methods suffer from at least one common disadvantage: the volatile corrosion inhibitors tend to produce, decompose into or otherwise leave behind a visible residue of chemicals. Such residues present a number of problems. First, the residual chemicals may cause health problems when they come in contact with a person's skin or are inhaled. Second, the residue can cause handling and mechanical problems, and third, the nature of some volatile corrosion inhibitors is such that they may react with some packaging materials or substrates with which they come in contact or to which they are applied. In other words, when blended with or impregnated into foams or applied to paper or other packaging materials, they may cause the materials to decompose, thereby aggravating the attendant problems listed above, or adding new problems; e.g. reduced shelf life.

Accordingly, there exists a need for a product and method for introducing volatile corrosion inhibitors inside closed packages or other enclosures which will provide the volatile corrosion inhibitors best suited for protecting packaged items, which will not react with the packaging material itself, and which will not form or otherwise leave behind a residue which must be eliminated or avoided during later unpacking, handling and finishing of the corrodible items. These volatile corrosion inhibitors may be accompanied with a desiccant so as to reduce the quantity of water vapor present in the package or other enclosure.

It is therefore an object of the present invention to provide a product which effectively distributes a volatile corrosion inhibitor within a package or another enclosure to effectively inhibit corrosion of items therein.

It is another object of the invention to provide a volatile corrosion inhibitor in a form which leaves no disadvantageous solid residue to cause later problems in the handling of the package, the enclosure, or the packaged or enclosed items.

It is a further object of this invention to provide a simple and easily accomplished method of adding volatile corrosion inhibitors to packages or enclosures and which is effective for a large number of different sizes and types of packages or enclosures and yet which requires very little in the way of customization or other specific tailoring.

It is yet a further object of the present invention to provide a simple and easily accomplished method of adding volatile corrosion inhibitors to packages or other enclosures, and wherein the volatile corrosion inhibitor may be packaged with a desiccant so as to reduce the quantity of water vapor present in the package or enclosure.

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments, and wherein:

DESCRIPTION OF THE PREFERRED EMBODIMENT

Figure 1:
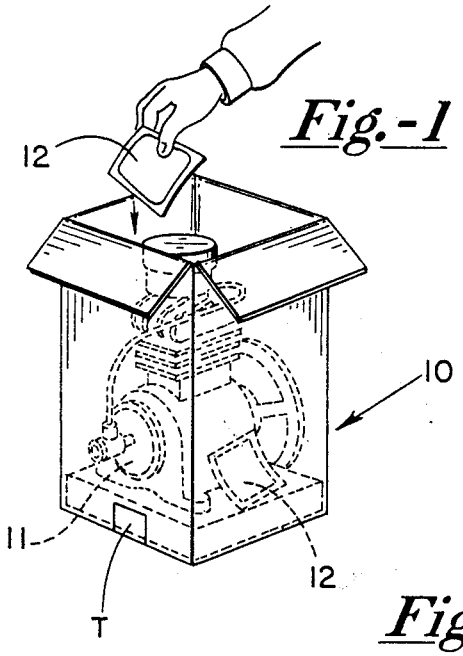
FIG. 1 is a perspective view of an open container carrying corrodible contents and showing two of the envelopes of the present invention.

The present invention is a product adapted to be used for inhibiting corrosion of corrodible items in closed containers. As one example of the use of the invention, FIG. 1 shows a box 10 having its lid open and a number of corrodible items 11 such as machine parts or the small engine illustrated therein. Placed in the box along with the corrodible items are at least one, or as many others as may be desired, product according to the present invention, shown in the form of an envelope broadly designated at 12.

As used herein, the expression "closed container" represents any enclosed environment, enclosed apparatus, instrument, housing or the like, in which corrodible items may be located and includes enclosed industrial environments and the like, as well as packages used for storage and shipment.

In order to inhibit the corrosion of the corrodible items, the envelope contains one or more powdered solid volatile corrosion inhibitor compositions capable of producing and releasing a vapor phase species which inhibits corrosion. Such compositions could be formulated as solid materials which directly sublime to form the vapor phase corrosion inhibiting species, or from which the protective vapor could otherwise be emitted.

The term "powdered solid" as used in the specification and claims should be understood to include a variety of readily friable agglomerations of materials, as well as powders per se. Such fragile and readily fracturable agglomerations can include tablets, pellets or prills, all of which can be formed to be readily fracturable into powders.

Examples of such compounds include, but are not limited to, triazoles; organic or inorganic nitrites, nitrates, carbonates, or phosphates; primary, secondary, tertiary, or quaternary amines (aliphatic or aromatic) or their organic or inorganic acid salts.

Nitrites are one type of preferred compound because they tend to hydrate in the presence of water vapor so that the normal migration of water vapor under ambient conditions carries the nitrites to the potentially corrodible surfaces to be protected. The chemical process by which nitrites inhibit corrosion is not completely understood, but the nitrites may form a weak bond with the corrodible (usually metal) surface and thereby form a microscopic layer of reaction product which prevents further reactions, e.g. corrosion, from taking place.

An even more preferred class of compounds are the organic or inorganic acid salts of amines. The amines can be primary, secondary or tertiary, and aliphatic or aromatic. The amine groups contribute the sublimable properties to the compound, and protectively react with cathodic areas on the corrodible surface. In turn, the carboxylate or carbonate groups protectively react with the anodic areas on the corrodible surface. As presently best understood, these compounds form weak coordinate covalent bonds with the corrodible surface and thus form a corrosion-inhibiting layer on the surface which can be on the order of 20 to 50 Angstroms thick.

Presently, the most preferred of the organic amine acid salts is cyclohexyl ammonium benzoate ("CHAB") which has both excellent volatility properties and excellent corrosion inhibiting properties.

In another example of the invention, a desiccant may be provided within the container for retaining the volatile corrosion inhibitor composition or compound. For example, one desiccant for use in admixture with the volatile corrosion inhibitors is aluminum silicate, preferably aluminum silicate in finely divided or powdered form. Powdered aluminum silicates are frequently referred to as aluminum silicate clay.

Other suitable desiccants may be employed as well. For example, silica gel may be employed, preferably without the combination of an indicator to provide an indication of a saturated condition. Molecular sieves fabricated from silica gel may also be found useful. As will be appreciated, the absorption of water vapor with the desiccants listed above is reversible, hence when the desiccant-volatile corrosion inhibitor package is subjected to a drier environment, the water vapor retained by the desiccant portion may be released.

In order to enclose and contain the volatile corrosion inhibitor composition, the envelope 12 is formed of a sheet material 13, which is impermeable to the solid composition, but all or a portion of which is porous to the released protective vapors produced by the volatile corrosion inhibitor. Using the solid volatile corrosion inhibitor in powdered form provides a convenient method of introducing the solid volatile corrosion inhibitor into the envelope 12. Under such circumstances, the vapors produced and released by the volatile corrosion inhibitor can migrate out of the envelope through the porous sheet material and permeate the environment of a container of corrodible items, thus protecting the items from corrosion.

Accordingly, one type of sheet material which has been found useful are fabric sheet materials. An appropriate fabric for the sheet material will be formed from a chemical composition which is generally nonreactive with both the selected volatile corrosion inhibitor and the resulting vapor. In practice, fibers formed from nylon, polytetrafluoroethylene (PTFE or Teflon®), polyethylene, other polyolefins, polyesters or polyamides have been found suitable. Most of these fibers are most successfully used as part of a non-woven fabric, but as has been applied in other engineering situations, synthetic fibers such as Teflon or Teflon coated fibers can be woven into a fabric which is impervious to solids and liquids, but porous to gases (e.g. Coretex® polytetrafluoroethylene woven fabrics). These sheet materials have been found useful for retention of the volatile corrosion inhibitor alone, or when utilized in combination with a desiccant, In a preferred embodiment of the invention, the fabric material comprises a non-woven fibrous fabric, the porosity and density of which can be maximized for use in the present invention by controlling the construction of the batt of fibers which are bonded to form the non-woven fibrous fabric.

In a most preferred embodiment of the invention, the non-woven fibrous fabric is a spun-bonded polyolefin. One method of forming such a fabric includes extruding the fiber, randomly spraying the extruded fibers onto a mat to form a batt of random fibers, folding the batt onto itself and then heat fusing the batt to form the final fabric. Under such conditions, the resulting fabric has a predictable average pore size, but each pore represents an indirect, sinuous or "tortuous" path among the random fibers between each respective surface of the sheet. These tortuous paths are only a negligible impediment to the passage of gases through the sheet, but make passage of solids virtually impossible. One such spun-bonded polyolefin sheet material is sold under the TYVEK® trademark by DuPont, Inc.

Figure 2:
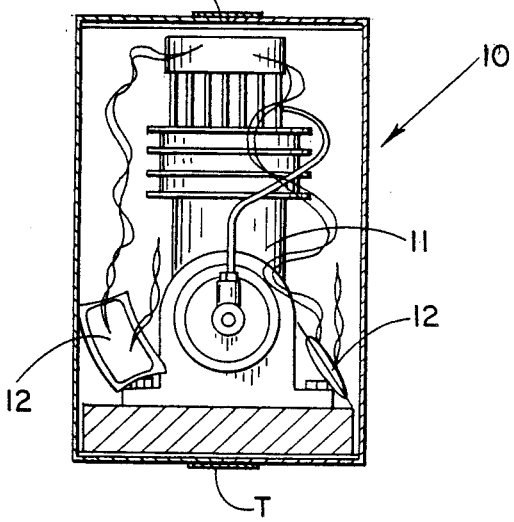
FIG. 2 is a cross-sectional view of the box of FIG. 1 having been closed to enhance and maximize the corrosion inhibiting effects of the vapor phase compound produced and released therein.
Figure 7:
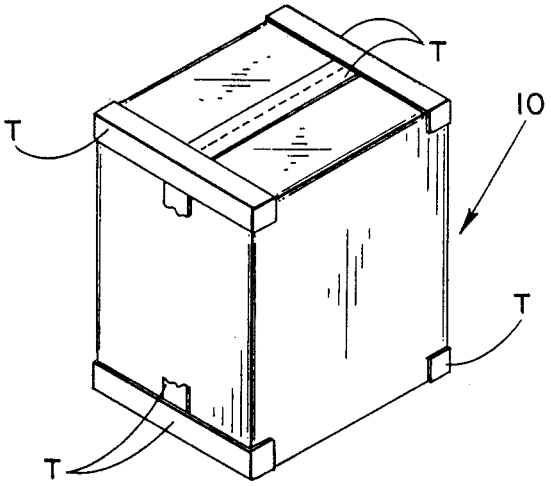
FIG. 7 is a perspective view of the box according to FIG. 5 after having been closed to enhance and maximize the corrosion inhibiting effects of the vapor phase compound produced and released therein.

As indicated by the closed container of FIGS. 2 and 7, which illustrate a closed box sealed with tape "T", although the invention will provide some protection in open environments, the effect of the volatile corrosion inhibitors will be greatest in closed or even sealed environments such as a closed or sealed box or other enclosure in which the volatile corrosion inhibitor can produce a vapor phase equilibrium within the closed environment of the container and thus enhance and maximize the corrosion inhibiting effect of the volatile corrosion inhibitor and the vapor it produces.

Figure 3:
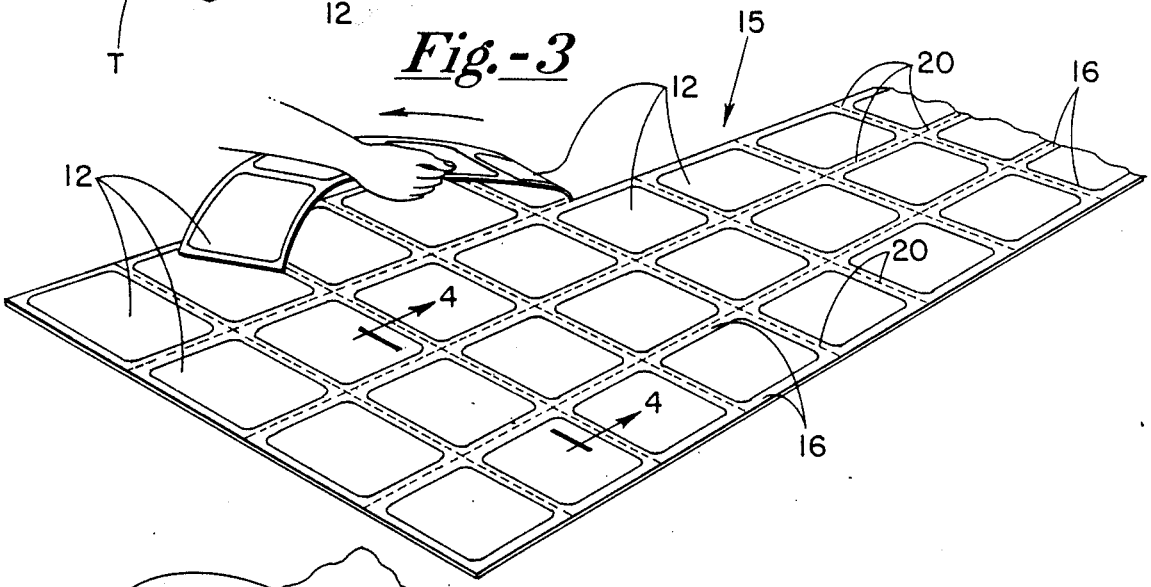
FIG. 3 is a perspective view of a sheet-like material formed of a grid-like array of envelopes of the present invention serially attached to one another.

FIG. 3 illustrates one preferred method of forming and arranging the envelopes 12 of the present invention. As shown in FIG. 3, a plurality of the sealed envelopes 12 may be serially attached to one another along their edges 14 to form a sheet-like array of the envelopes broadly designated at 15. The array of envelopes is formed from two overlying pieces of the sheet material 13 joined to one another along a grid-like pattern to form the individual envelopes between the joints of the grid, with the joints between envelopes designated at 16. It will be understood that such an array can be formed in a number of other configurations, including one in which the envelopes are attached end-to-end to form a strip-like array 17 of envelopes, as is illustrated for example, in FIG. 5.

As illustrated in FIG. 3, in preferred embodiments of the sheet-like array, a series of perforations 20 may be formed along the joints 16 of the array 15 of envelopes 12. Forming the envelopes in the array adds a great deal of flexibility to their use in that any desired number of envelopes can be separated from the array along the perforations 20 to select and form a "mini-grid" of serially attached envelopes in some patten which may be more suitable for a particular size or shape of package or corrodible item.

Figure 4:
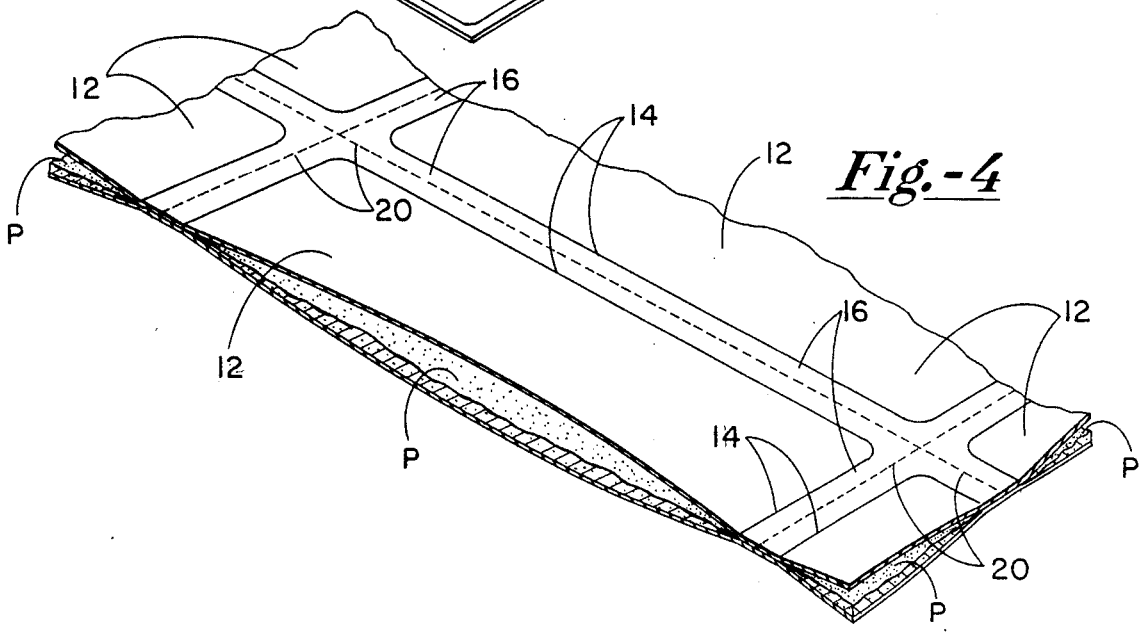
FIG. 4 is an enlarged partial perspective and partial cross-sectional view taken along lines 4—4 of FIG. 3.

As seen in the partially perspective partial cross-sectional view of FIG. 4, each individual envelope is formed from two respective portions of the sheet material 13 sealed along their edges 14 to form the envelope 12 which encloses the powdered composition "P". Because the sheet material is impermeable to the powdered material, the invention eliminates the dust-generation, skin-contact, and inhalation exposure that have heretofore resulted when powdered solid volatile corrosion inhibitor compositions have been used to generate corrosion-inhibiting vapors.

As further seen in FIG. 4, the envelope 12 forms a thin, pillow-like enclosure which contains a relatively thin layer, typically about one-sixteenth inch, of the powdered solid composition.

Figure 5:
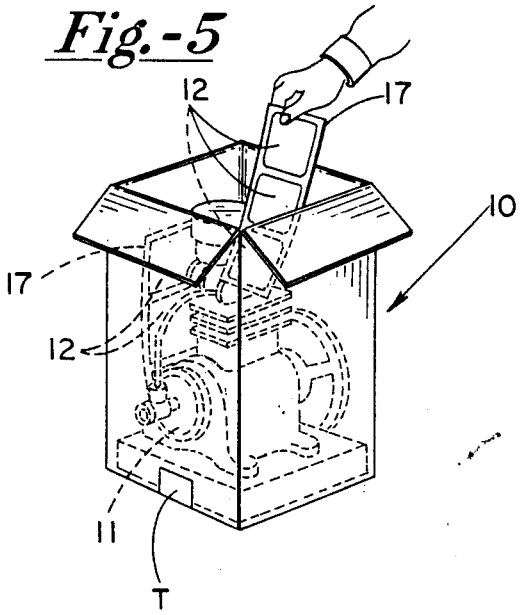
FIG. 5 shows an open box and corrodible contents therein along with a plurality of envelopes of the present invention serially attached to one another.

As seen in FIGS. 1 and 5, one advantage of the invention is the ease with which a volatile corrosion inhibitor can be provided in a package. One or more envelopes according to the present invention can simply and easily be placed in a box, usually immediately prior to the box being closed, to provide the corrosion inhibition desired. Assemblers or packagers need not handle or mix liquids, solids, dust, foams or other compositions during the packaging or assembly process, but rather can simply add the product to the box or enclosure before closing it.

Figure 6:
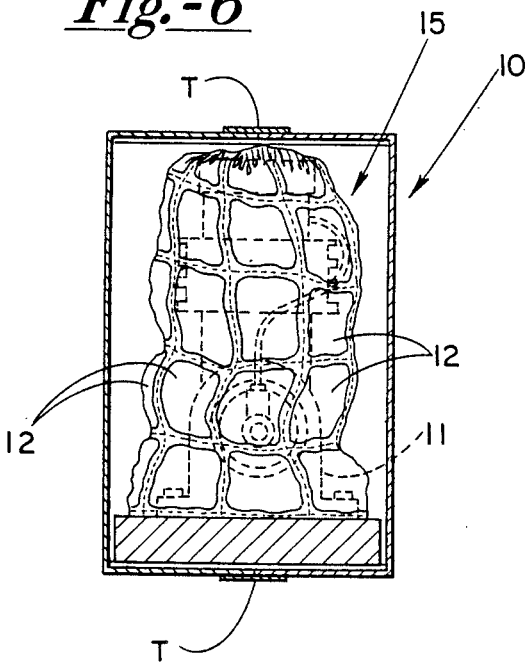
FIG. 6 is a cross-sectional view of an open box carrying corrodible items wrapped in a sheet-like wrapping material formed according to the present invention.

FIG. 6 shows an alternative method of using the present invention. In FIG. 6, an array similar to that shown in FIG. 3 is used as a wrapping material, rather than as a package added to the container 10. As seen in FIG. 6, a corrodible item 11 may be wrapped in an entire array 15 of envelopes, the size, flexibility and composition content of which can be tailored according to needs of the particular packaging so as to form a highly flexible, "wrappable", material. Because the invention can be used in this wrappable fashion, the array 15 of envelopes 12 can also serve as additional cushioning for the items as well as for corrosion inhibition.

When a desiccant component is utilized in combination with the volatile corrosion inhibitors of the present invention, these desiccants are preferably of the type compatible with and in conformance with that certain military specification, such as MIL-D-3464-E. Furthermore, when aluminum silicate is employed as the desiccant component, 33 grams of aluminum silicate is normally employed per cubic foot of enclosure volume.

The quantity of volatile corrosion inhibitor of the types listed hereinabove is normally in the range of about 2 grams per cubic foot of enclosure being monitored and protected.

Normally, because of the volatile nature of the volatile corrosion inhibitors, the array, or mini-grid, or individual envelopes will be contained prior to their use, as by wrapping or otherwise packaging, in some manner which prevents excessive loss of the protective vapors until the envelopes are placed in use as corrosion inhibitors in enclosed containers. Such treatment is also appropriate for those systems employing the combination of a volatile corrosion inhibitor and desiccant as the active components.

Accordingly, the invention also comprises a method of inhibiting the corrosion of corrodible items within closed containers by enclosing an appropriate powdered composition in a sealed envelope in which the envelope is formed from one of the sheet materials impermeable to the volatile corrosion inhibitor but porous to the vapor emitted therefrom, placing the sealed envelope of powdered composition in a container of corrodible items and sealing the container to maximize the corrosion inhibiting effects of the vapor phase compound therein. As set forth herein, the invention also comprises a method of wrapping an array of such envelopes around a corrodible item and then closing its container to thereby provide a volatile corrosion inhibitor to the environment of the closed container.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A product adapted to be used for inhibiting corrosion of corrodible items within closed containers, said product comprising:

(a) a powdered solid composition capable of producing and releasing a vapor phase corrosion inhibiting compound;

(b) a sealed envelope containing said powdered solid composition, portions of said envelope being formed of a sheet material impermeable to said powdered solid composition, but porous to the released vapor phase corrosion inhibiting compound released from said powdered solid composition, whereby the vapor phase corrosion inhibiting compound produced and released by the powdered composition leaves the envelope and permeates the environment of a closed container of corrodible items; and (c) said sheet material comprises a fabric formed from fibers which are selected from the group consisting of: nylon, polytetrafluoroethylene, polyethylene, polyolefins, polyesters, or polyamides.

2. A product according to claim 1 wherein said powdered solid composition is selected from the group consisting of: triazoles, organic nitrates, organic nitrites, inorganic nitrates, inorganic nitrites, inorganic carbonates, organic carbonates, organic phosphates, inorganic phosphates, and amines.

3. A product according to claim 2 wherein said powdered composition is a combination of at least two members of the group consisting of: triazoles, organic nitrates, organic nitrites, inorganic nitrates, inorganic nitrites, inorganic carbonates, organic carbonates, organic phosphates, inorganic phosphates, and amines.

4. A product according to claim 1 wherein said powdered composition is an acid salt of a primary, secondary, tertiary or quaternary amine.

5. A product according to claim 1 wherein said powdered composition comprises an amine carboxylate.

6. A product according to claim 1 wherein said powdered composition comprises cyclohexyl ammonium benzoate.

7. A product according to claim 1 wherein said sheet material includes a plurality of microscopic pores wherein substantially all of said pores form individual indirect sinuous paths through said sheet material form one side thereof to the other.

8. The combination of a closed container having corrodible items and a product therein for inhibiting corrosion of such items, said product comprising:

(a) a sealed envelope;

(b) a powdered solid composition capable of producing and releasing a vapor phase corrosion inhibiting compound contained in said envelope;

(c) said envelope being formed from a sheet material which is impermeable to said contained powdered solid composition but porous to the released vapor phase corrosion inhibiting compound released therefrom, whereby the vapor phase corrosion inhibiting compound produced and released by said powdered solid composition leaves the sealed envelope and permeates the environment of the closed container to protect the corrodible items therein; and (d) said sheet material comprising a non-woven fibrous fabric of spun-bonded polyolefin.

9. The combination of a closed container having corrodible items and a product therein for inhibiting corrosion of such items, said product comprising:

(a) a sealed envelope;

(b) a powdered solid composition capable of producing and releasing a vapor phase corrosion inhibiting compound contained in said envelope;

(c) said envelope being formed from a sheet material which is impermeable to said contained powdered solid composition but pervious to the released vapor phase corrosion inhibiting compound released therefrom, whereby the vapor phase corrosion inhibiting compound produced and released by said powdered solid composition leaves the sealed envelope and permeates the environment of the closed container to protect the corrodible items therein; and (d) said sheet material comprising a fabric formed from fibers which are selected from the group consisting of: nylon, polytetrafluoroethylene, polyethylene, polyolefins, polyesters, or polyamides.

10. A product adapted to be used for inhibiting corrosion of corrodible items within closed containers, said product comprising:

(a) a plurality of sealed envelopes serially attached to one another along their edges to form a sheet-like array of said envelopes, said array of envelopes comprising two overlying sheets joined to one another along a grid-like pattern to form the individual envelopes between the joints of the grid;

(b) a powdered solid composition capable of producing and releasing a vapor phase corrosion inhibiting compound positioned within and contained in each sealed envelope in said array;

(c) said sheet material being impermeable to said powdered solid composition, but porous to the released vapor phase corrosion inhibiting compound released from the powdered solid composition, whereby the vapor phase corrosion inhibiting compound produced and released by the powdered solid composition leaves the envelopes in the array and permeates the environment of a closed container of corrodible items; and (d) said sheet material comprising a non-woven fibrous fabric of spun-bonded polyolefin.

11. A product adapted to be used for inhibiting corrosion of corrodible items within closed containers, said product comprising:

(a) a plurality of sealed envelopes serially attached to one another along their edges to form a sheet-like array of said envelopes, said array of envelopes comprising two overlying sheets joined to one another along a grid-like pattern to form the individual envelopes between the joints of the grid;

(b) a powdered solid composition capable of producing and releasing a vapor phase corrosion inhibiting compound positioned within and contained in each sealed envelope in said array;

(c) said sheet material being impermeable to said powdered solid composition, but porous to the released vapor phase corrosion inhibiting compound released from the powdered solid composition, whereby the vapor phase corrosion inhibiting compound produced and released by the powdered solid composition leaves the envelopes in the array and permeates the environment of a closed container of corrodible items; and (d) said sheet material comprises a fabric formed from fibers which are selected from the group consisting of: nylon, polytetrafluoroethylene, polyethylene, polyolefins, polyesters, or polyamides.

12. A product according to claim 10 or 11 wherein said array of envelopes further comprises means dispersed along said grid-like pattern of joints between individual envelopes for making individual sealed envelopes removable from said array of sealed envelopes.

13. A product according to claim 12 wherein said means disposed along said grid-like pattern comprises a series of perforations for making individual sealed envelopes removable from said array of sealed envelopes.

14. A product according to claim 12 wherein said plurality of sealed envelopes are serially attached end-to-end to one another to form a strip-like array of envelopes.

15. A method of inhibiting the corrosion of corrodible items within closed containers, said method comprising:

(a) enclosing in a sealed envelope a powdered solid composition capable of producing and releasing a vapor phase corrosion inhibiting compound and wherein the envelope is formed from a non-woven fibrous spun-bonded polyolefin fabric impermeable to the powdered solid but porous to the vapor phase corrosion inhibiting compound released therefrom;

(b) placing the sealed envelope of powdered solid composition in a container of corrodible items; and (c) sealing the container to maximize the corrosion inhibiting effects of the vapor phase compound produced and released therein.

16. A method of inhibiting the corrosion of corrodible items within closed containers, said method comprising:

(a) enclosing in a sealed envelope a powdered solid composition capable of producing and releasing a vapor phase corrosion inhibiting compound and wherein the envelope is formed from a fabric formed from fibers which are selected from the group consisting of: nylon, polytetrafluoroethylene, polyethylene, polyolefins, polyesters, or polyamides impermeable to the powdered solid but porous to the vapor phase corrosion inhibiting compound released therefrom;

(b) placing the sealed envelope of powdered solid composition in a container of corrodible items; and (c) sealing the container to maximize the corrosion inhibiting effects of the vapor phase compound produced and released therein.

17. A method according to claim 15 or 16 wherein said powdered solid composition is selected from the group consisting of: triazoles, organic nitrates, organic nitrites, inorganic nitrates, inorganic nitrites, inorganic carbonates, organic carbonates, organic phosphates, inorganic phosphates, and amines.

18. A method according to claim 17 wherein said powdered composition is a combination of at least two members of the group consisting of: triazoles, organic nitrates, organic nitrites, inorganic nitrates, inorganic nitrites, inorganic carbonates, organic carbonates, organic phosphates, inorganic phosphates, and amines.

19. A method according to claim 15 or 16 wherein said powdered composition is an acid salt of a primary, secondary, tertiary or quaternary amine.

20. A method according to claim 15 or 16 wherein said powdered composition comprises an amine carboxylate.

21. A method according to claim 15 or 16 wherein said powdered composition comprises cyclohexyl ammonium benzoate.

22. A method according to claim 15 or 16 wherein said sheet material includes a plurality of microscopic pores wherein substantially all of said pores form individual indirect sinuous paths through said sheet material from one side thereof to the other.

23. A method according to claim 15 wherein said powdered solid composition includes a first component capable of producing and releasing a vapor phase corrosion inhibiting compound and a second compound consisting of a desiccant and wherein the envelope is impermeable to the powdered solid but porous to water vapor and to the vapor phase corrosion inhibiting compound released therefrom.

24. A method according to claim 16 wherein said powdered solid composition includes a first component capable of producing and releasing a vapor phase corrosion inhibiting compound and a second compound consisting of a desiccant and wherein the envelope is impermeable to the powdered solid but porous to water vapor and to the vapor phase corrosion inhibiting compound released therefrom.

25. A method of inhibiting the corrosion of corrodible items within closed containers, said method comprising:

(a) wrapping a corrodible item in a sheet of non-woven fibrous fabric of spun-bonded polyolefin formed as a plurality of sealed envelopes serially attached to one another along their edges to form an array of said envelopes, said array of envelopes comprising two overlying sheets joined to one another along a grid-like pattern to form the individual envelopes between the joints of the grid, and with each sealed envelope in said array containing a powdered solid composition positioned therein capable of producing and releasing a vapor phase corrosion inhibiting compound, and said sheet material being impermeable to said powdered composition, but porous to the vapor phase corrosion inhibiting compound released from the powdered composition, whereby the vapor phase corrosion inhibiting compound leaves the envelope and permeates the surrounding environment;

(b) placing the wrapped item in a container; and (c) closing the container to maximize the corrosion inhibiting effects of the vapor phase compound produced and released therein.

26. A method of inhibiting the corrosion of corrodible items within closed containers, said method comprising:

(a) wrapping a corrodible item in a sheet of fabric formed from fibers which are selected from the group consisting of: nylon, polytetrafluoroethylene, polyethylene, polyolefins, polyesters, or polyamides formed as a plurality of sealed envelopes serially attached to one another along their edges to form an array of said envelopes, said array of envelopes comprising two overlying sheets joined to one another along a grid-like pattern to form the individual envelopes between the joints of the grid, and with each sealed envelope in said array containing a powdered solid composition positioned therein capable of producing and releasing a vapor phase corrosion inhibiting compound, and said sheet material being impermeable to said powdered composition, but porous to the vapor phase corrosion inhibiting compound released from the powdered composition, whereby the vapor phase corrosion inhibiting compound leaves the envelope and permeates the surrounding environment;

(b) placing the wrapped item in a container; and (c) closing the container to maximize the corrosion inhibiting effects of the vapor phase compound produced and released therein.

27. A method according to claim 25 or 26 wherein said powdered solid composition is selected from the group consisting of: triazoles, organic nitrates, organic nitrites, inorganic nitrates, inorganic nitrites, inorganic carbonates, organic carbonates, organic phosphates, inorganic phosphates, and amines.

28. A method according to claim 25 or 26 wherein said powdered composition is a combination of at least two members of the group consisting of: triazoles, organic nitrates, organic nitrites, inorganic nitrates, inorganic nitrites, inorganic carbonates, organic carbonates, organic phosphates, inorganic phosphates, and amines.

29. A method according to claim 25 or 26 wherein said powdered composition is an acid salt of a primary, secondary, tertiary or quaternary amine.

30. A method according to claim 25 or 26 wherein said powdered composition comprises an amine carboxylate.

31. A method according to claim 25 or 26 wherein said powdered composition comprises cyclohexyl ammonium benzoate.

32. A method according to claim 25 or 26 wherein said sheet material includes a plurality of microscopic pores wherein substantially all of said pores form individual indirect sinuous paths through said sheet material from one side thereof to the other.

33. The method according to claim 25 or 26 wherein said powdered solid composition includes two components, the first being capable of producing and releasing a vapor phase corrosion inhibiting compound, the second being a desiccant capable of attracting and retaining water vapor.

* * * * *